US008408132B2

(12) United States Patent
Lucas et al.

(10) Patent No.: US 8,408,132 B2
(45) Date of Patent: Apr. 2, 2013

(54) INITIATOR MODULES, MUNITIONS SYSTEMS INCLUDING INITIATOR MODULES, AND RELATED METHODS

(75) Inventors: James D. Lucas, Chanhassen, MN (US); Denny L. Kurschner, Minnetonka, MN (US); Thomas E. MacPherson, Robbinsdale, MN (US)

(73) Assignee: Alliant Techsystems Inc., Arlington, VA (US)

( * ) Notice: Subject to any disclaimer, the term of this patent is extended or adjusted under 35 U.S.C. 154(b) by 251 days.

(21) Appl. No.: 12/723,446

(22) Filed: Mar. 12, 2010

(65) Prior Publication Data

US 2011/0219977 A1 Sep. 15, 2011

(51) Int. Cl.

| | |
|---|---|
| ***F42B 3/10*** | (2006.01) |
| ***F23Q 21/00*** | (2006.01) |
| ***F42C 19/00*** | (2006.01) |
| ***F42C 11/00*** | (2006.01) |

(52) U.S. Cl. ..... 102/202.7; 102/202.14; 102/215; 102/275.12; 102/275.6; 102/206

(58) Field of Classification Search ..... 102/202.5, 102/202.7, 202.9, 202.12, 202.14, 206, 215, 102/217, 218, 275.6, 275.12
See application file for complete search history.

(56) References Cited

U.S. PATENT DOCUMENTS

| | | | | |
|---|---|---|---|---|
| 2,972,949 | A | 2/1961 | MacLeod | |
| 4,962,708 | A * | 10/1990 | Snyder et al. | 102/275.11 |
| 5,144,893 | A | 9/1992 | Zeman et al. | |
| 5,341,742 | A | 8/1994 | Alford et al. | |
| 5,351,623 | A | 10/1994 | Kissel et al. | |
| 6,006,671 | A | 12/1999 | Yunan | |
| 6,142,079 | A | 11/2000 | Diorio | |
| 6,196,131 | B1 * | 3/2001 | Yanda et al. | 102/275.11 |
| 6,272,996 | B1 | 8/2001 | O'Brien et al. | |
| 6,308,607 | B1 | 10/2001 | Woodall et al. | |
| 6,546,873 | B1 | 4/2003 | Andrejkovics et al. | |
| 6,584,905 | B1 | 7/2003 | Snyder | |
| 6,892,645 | B2 * | 5/2005 | Nodine | 102/275.11 |
| 7,451,700 | B1 | 11/2008 | Land | |
| 7,665,401 | B2 * | 2/2010 | Ballantine et al. | 102/275.11 |
| 7,739,954 | B2 * | 6/2010 | Chan et al. | 102/275.7 |
| 7,765,932 | B2 * | 8/2010 | Allman | 102/275.11 |
| 7,814,833 | B1 * | 10/2010 | Land | 102/275.6 |
| 2008/0210118 | A1 | 9/2008 | Chan et al. | |

FOREIGN PATENT DOCUMENTS

| | | | |
|---|---|---|---|
| WO | 99/46221 | A1 | 6/1999 |
| WO | 2009/097036 | A2 | 8/2009 |

OTHER PUBLICATIONS

Product datasheet for Spyder, copyright 2006, available at http://www.atk.com/datasheet_PDFs/spider.pdf.

* cited by examiner

*Primary Examiner* — James Bergin
(74) *Attorney, Agent, or Firm* — TraskBritt

(57) ABSTRACT

Initiator modules for munitions control systems include a mounting portion for receiving a portion of an initiation device, a detonator device disposed within the initiator module, a connection portion configured to connect the initiator module with a munitions control system, and an electronics assembly configured to electronically couple with a munitions control system and transmit a signal to the detonator device. Munitions systems may include initiator modules received in a socket of a munitions control system. Methods of igniting explosive devices include coupling a shock tube to an explosive device, connecting an initiator module to a munitions control system, mounting a portion of the shock tube to the initiator module, and igniting the shock tube with a detonator device disposed within the initiator module.

20 Claims, 5 Drawing Sheets

INITIATOR MODULES, MUNITIONS SYSTEMS INCLUDING INITIATOR MODULES, AND RELATED METHODS

STATEMENT REGARDING FEDERALLY SPONSORED RESEARCH OR DEVELOPMENT

This invention was made with government support under Contract Number W15QKN-08-C-0448 awarded by the United States Department of Defense. The government has certain rights in the invention.

TECHNICAL FIELD

The current invention relates generally to initiator modules and munitions systems. In particular, the current invention generally relates to initiator modules for actuating an initiation device such as, for example, a shock tube, systems including initiator modules, and methods of igniting explosive devices using initiator modules.

BACKGROUND

Explosives used in military combat may be initiated by detonation devices. Due to the destructive nature of explosives, these detonation devices may incorporate various safety features to avoid premature detonation. Explosive materials may be ignited in several different ways. Typically, explosive materials have been ignited by flame ignition (e.g., fuzes or ignition of a priming explosive), impact (which often ignites a priming explosive), chemical interaction (e.g., contact with a reactive or activating fluid), or electrical ignition. Electrical ignition may occur in two distinct ways, as by ignition of a priming material (e.g., electrically ignited blasting cap or priming material) or by direct energizing of an explosive mass by electrical power.

Remote activation systems for detonating explosives have been used widely in the field of military and industrial demolition applications. In the past, initiation devices have been used to generate an electrical impulse for initiating detonation. For example, a blasting cap used in conjunction with an explosive charge (e.g., pentaerythritol tetranitrate (PETN), C4, etc.) can be electrically connected to output terminals of the initiation device using electrical conductors. In many instances, the conductors can be several hundred meters long to separate the initiation device and the explosive. In such an arrangement, the explosive assembly is sensitive to electrical conditions, such as electromagnetic interference (EMI) and electrostatic discharge (ESD). As a result of this sensitivity, premature detonation of the explosive charge has been known to occur with unacceptable frequency. The results of premature detonation can include unintended damage and/or unintended personal injury or death.

Attempts have been made to avoid using electrical conductors to deliver explosion initiating energy from the initiation device to the explosive change. In one attempt a mechanical arm driven by a solenoid was used to initiate a device that propagates a chemical reaction from initiator to explosive. Such an attempt is described in U.S. Pat. No. 6,546,873 which discloses a transmitter that transmits a detonation signal to a receiver. The receiver can be configured to deliver an electrical output in response to a received detonation signal. Such electrical output can be used to electrically excite a blasting cap via conductors. But, as indicated above, if the conductors have any appreciable length (e.g., 50 meters or more), ambient electrical conditions (e.g., an atmospheric electrical storm) can cause premature detonation of the explosive.

Another attempt is described in U.S. Pat. No. 7,451,700 which discloses a detonation initiator including a linear actuator assembly having a core with a permanent magnet. The linear actuator assembly propels the core along the longitudinal axis of the linear actuator assembly when the charge on the capacitor reaches a charge threshold. The core includes a firing pin that mechanically strikes a primer connected to an open end of a shock tube. Striking the primer in results in chemical activation of the primer and, in turn, begins ignition of combustible material in the shock tube. However, such a configuration requires that an open end of the shock tube be inserted into the detonation initiator in order to be initiated. The end of the shock tube must be cut or otherwise opened and inserted into the device adjacent to the primer. Exposing the end of a shock tube may be undesirable as the shock tube may become contaminated or exposed to other undesirable environmental condition. Further, if the partially exposed shock tube is not detonated, all or part of the unused shock tube (including any detonation devices connected to the shock tube) may not be reused and will be wasted. As also illustrated in U.S. Pat. No. 7,451,700, the connection between the shock tube and primer and position of the shock tube within the initiator may be critical in assuring proper ignition of the shock tube. As such, the detonation initiator disclosed therein requires proper placement of the shock tube within the initiator and may not be applicable for use with shock tubes of varying sizes.

BRIEF SUMMARY

In some embodiments, the present invention includes an initiation module for a munitions control system comprising a mounting portion for receiving a longitudinal portion of an initiation device, a detonator device disposed within the initiator module at a location proximate to the mounting portion, a connection portion configured to connect the initiator module with a munitions control system, and an electronics assembly configured to electronically couple with a munitions control system through the connection portion and to transmit a signal from a munitions control system through the connection portion and to the detonator device.

In additional embodiments, the present invention includes a munitions system comprising a munitions control system having at least one socket formed therein and at least one initiator module received in the at least one socket of the munitions control system. The at least one initiator module comprises a first end and a second, opposing end. The first end comprises an electrical connector connected to a complementary electrical connector disposed in the at least one socket of the munitions control system. The second, opposing end of the at least one initiator module includes a mount comprising a biasing element. The mount may be configured to receive a longitudinal portion of a shock tube and the biasing element may be configured to retain the longitudinal portion of the shock tube in the mount. An exploding foil initiator may be disposed within a housing of the initiator module proximate to the mount, and an electronics assembly may be electronically coupled to the exploding foil initiator and to the electrical connector. The electronics assembly may be configured to receive a signal from the munitions control system through the electrical connector and to initiate the exploding foil initiator.

In yet additional embodiments, the present invention includes a method of igniting an explosive device. The method comprises coupling a shock tube to an explosive device, connecting an initiator module to a munitions control system, mounting a longitudinal portion of the shock tube to a mount disposed on an exterior surface of the initiator module, and igniting the shock tube with a detonator device disposed within the initiator module proximate to the mount with a signal generated by the munitions control system.

BRIEF DESCRIPTION OF THE SEVERAL VIEWS OF THE DRAWINGS

While the specification concludes with claims particularly pointing out and distinctly claiming that which is regarded as embodiments of the present invention, the advantages of embodiments of the invention may be more readily ascertained from the following description of embodiments of the invention when read in conjunction with the accompanying drawings in which:

DETAILED DESCRIPTION

The illustrations presented herein are not meant to be actual views of any particular material, apparatus, system, or method, but are merely idealized representations which are employed to describe embodiments of the present invention. Additionally, elements common between figures may retain the same numerical designation for convenience and clarity.

Figure 1:
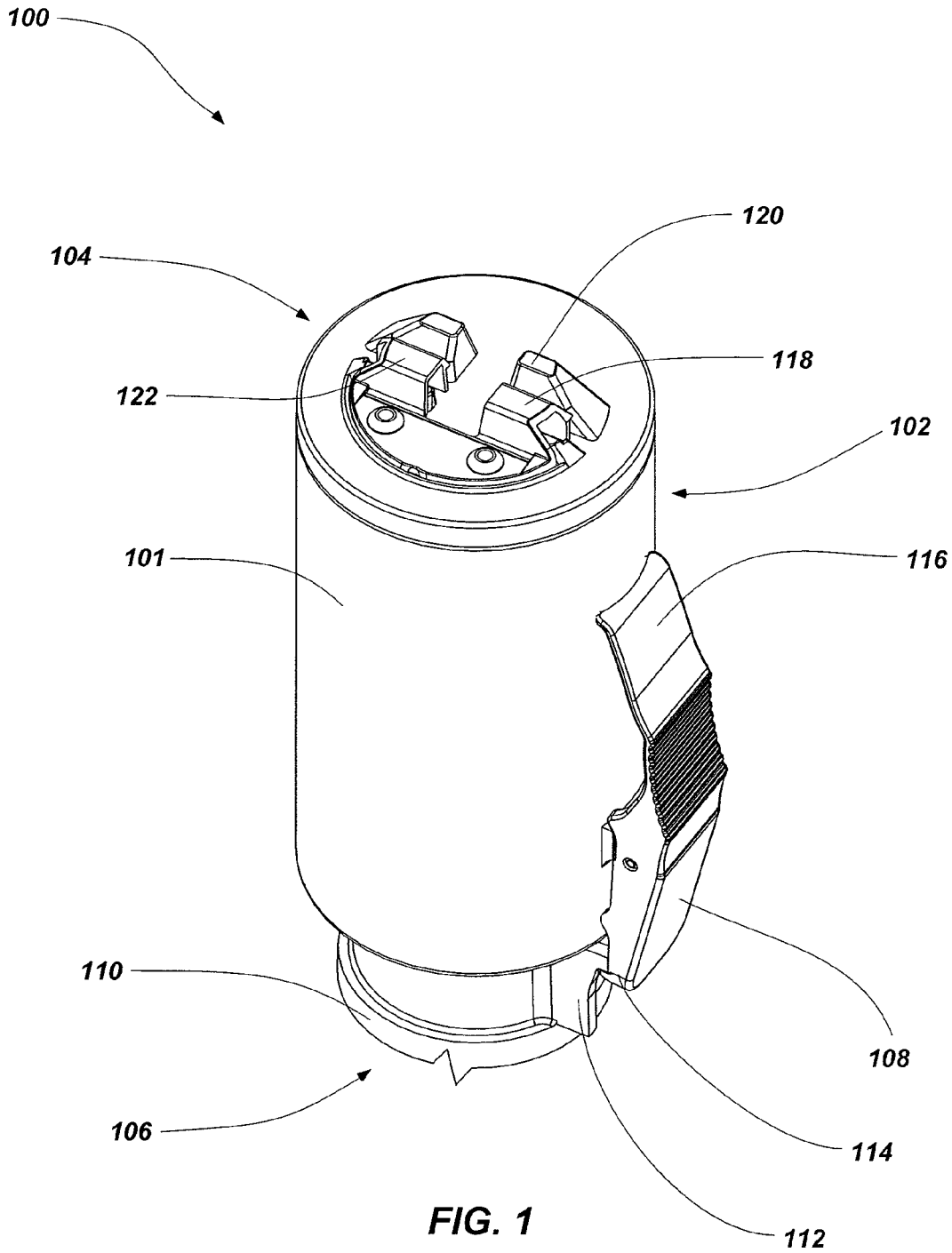
FIG. 1 is a perspective view of an embodiment of an initiator module of the present invention.

FIG. 1 is a perspective view of an embodiment of an initiator module. As shown in FIG. 1, an initiator module 100 having a housing 101 may include a body 102, a mounting portion 104, and a connection portion 106. In some embodiments, the mounting portion 104 and the connection portion 106 of the initiator module 100 may be coupled to the body 102 at opposite ends thereof. For example, the mounting portion 104 may be connected to the body 102 at a distal end of the body 102 (i.e., distal to the point of connection of the initiator module 100 to a munitions control system 110) and the connection portion 106 may be connected to the body 102 at a proximal end of the body 102 (i.e., proximate to the point of connection of the initiator module 100 to a munitions control system 110). It is noted that, while the mounting portion 104 and the connection portion 106 are shown and described with reference to FIG. 1 as being located on opposing ends of the body 102 of the initiator module 100, the mounting portion 104 and connection portion 106 may be disposed respectively at any suitable location of the initiator module 100.

The housing 101 (e.g., the body 102) of the initiator module 100 may house components of the initiator module 100 such as electronics and initiator assemblies, which are discussed in further detail below. For example and as shown in FIG. 1, the body 102 may be formed as a hollow cylinder which may be employed to house operational components of the initiator module 100 therein. The body 102 may include a retaining feature (e.g., a latch 108) that may at least partially secure the initiator module 100 to a portion of a munitions control system 110. As discussed herein, a munitions control system 110 may include any system, assembly, or device capable of supplying an electrical signal to the initiator module 100. For example, the munitions control system 110 may comprise an electric system capable of supplying a signal to the initiator module 100 in order to initiate a detonator device 132 (FIG. 2) of the initiator module 100. In some embodiments, the munitions control system 110 may be remotely controlled enabling a user to remotely initiate the initiator module 100 with the munitions control system 110.

By way of further example, the munitions control system 110 may include a safe and arm device (also termed a SAD or an S&A). Safe and arm devices may include an assembly or system that mechanically or electrically (i.e., electronic safe and arm devices (ESADs)) interrupts an explosive train and prevents inadvertent functioning of an initiation assembly. For example, an ESAD may isolate electronic components between a power source and a detonator to inhibit inadvertent firing of an explosive charge. Such a munitions control system 110 including an ESAD may supply a voltage to the initiator module 100 only when it is desired to ignite the initiator module 100. For example, the munitions control system 110 may comprise an assembly or system such as a Spider Tactical Munitions System ("Spider") developed and manufactured by Alliant Techsystems Inc. of Minneapolis, Minn. and Textron Systems Corporation of Wilmington, Mass. The Spider is a portable (e.g., battery-operated), reusable, soldier-in-the-loop system that can be used in either a lethal, or a non-lethal mode. The Spider includes hand emplaced munitions control units (MCUs) and is controlled by a remote control unit (e.g., a laptop computer) where an operator (i.e., the soldier-in-the-loop) decides whether to detonate the modules attached to the MCUs (e.g., a miniature grenade launcher (MGL), non-lethal launcher (NLL), etc.). The MCUs may also include munitions adaptor modules (MAM) that enable the on-command operation of other explosive devices connected to the Spider by an electrical detonation wire. The Spider system may also be used with, for example, training simulator modules (e.g., a MGL training module (MGTS)) which include attachable modules that may be used by the soldiers for training with the Spider system. Using the training simulator modules, Spider system functions, such as simulated detonation of munitions, may be performed with the training simulator modules as part of training exercises without any safety hazards, and yet full system functionality. As mentioned above, the modules may include non-lethal launcher (NLL) modules. The NLL modules include a variety of "less than lethal" effects that the Spider may deploy against oncoming forces or intruders. The effects include a flash-bang grenade, a sting-ball grenade, and a marking round composed of chalk and paint balls. The NLL module may replace an MGL module to still provide deterrence, but in a non-lethal manner.

Figure 2:
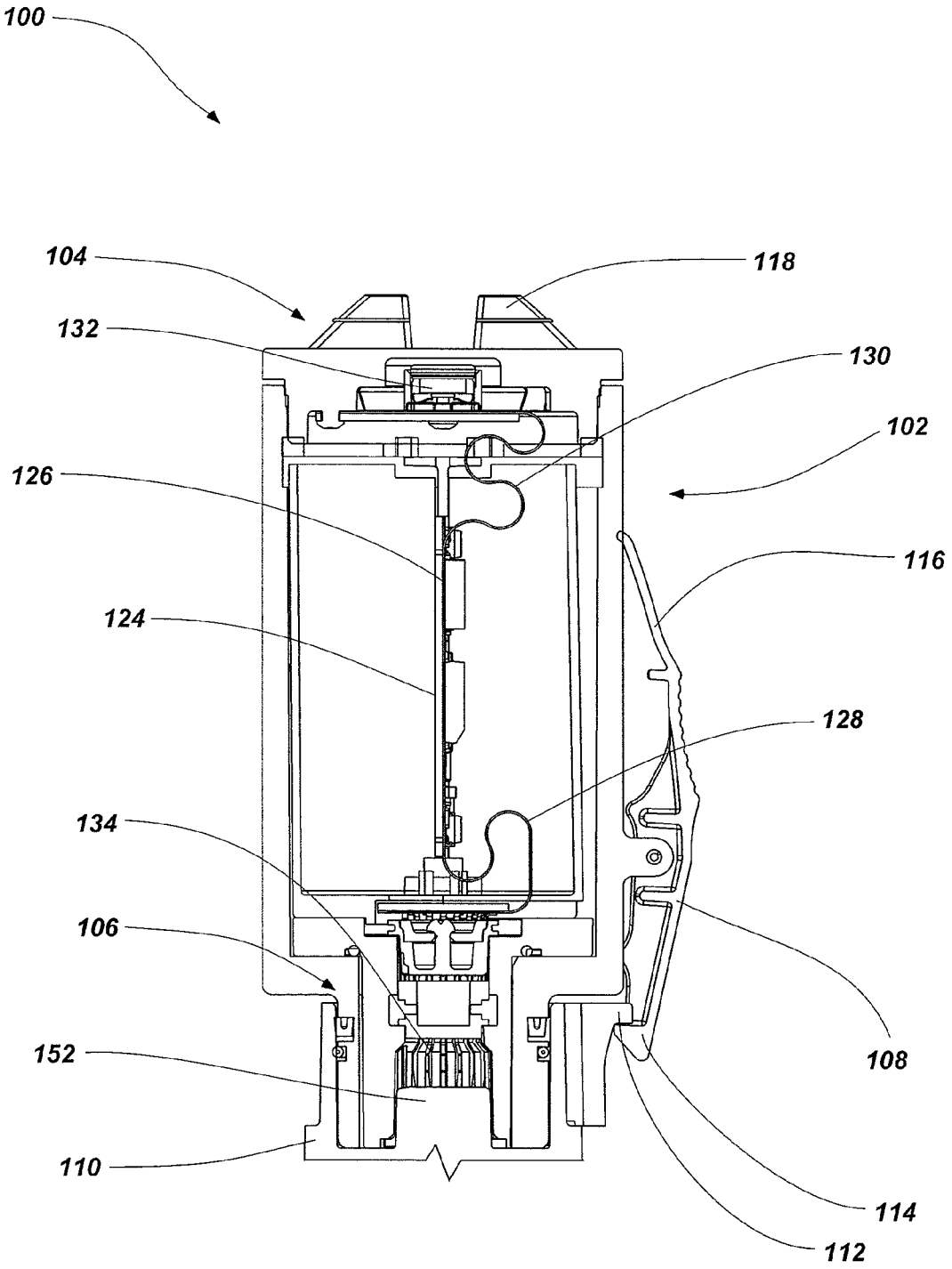
FIG. 2 is a partial cross-sectional view of the initiator module shown in FIG. 1.

Referring still to FIG. 1 and to FIG. 2, the latch 108 may include an elongated member that is rotationally coupled to the base 102 of the initiator module 100. The latch 108 may include a latching portion 114 that is complementary to a latching portion 112 of the munitions control system 110. When the initiator module 100 is coupled to a munitions control system 110, the latching portion 114 of the latch 108 may extend around the latching portion 112 of the munitions control system 110 to substantially prevent the initiator module 100 from being removed from the munitions control system 110 without releasing the latch 108. The latch 108 may include a biasing portion 116 that may act to maintain the latching portion 114 of the latch 108 in engagement with the latching portion 112 of the munitions control system 110. When the initiator module 100 is to be removed from a munitions control system 110, a force applied to the latch 108 in a direction toward the body 102 of the initiator module 100 at a location proximate to the biasing portion 116 may be used to disengage the latching portion 114 of the latch 108 and enable the initiator module 100 to be removed from the munitions control system 110.

The mounting portion 104 of the initiator module 100 may include an attachment feature (e.g., a mount 118) which may provide a seat for (e.g., receive or couple) a portion of a detonation device or initiation device (discussed below in further detail with reference to FIGS. 3 and 4) to the initiator module 100. The mounting portion 104 of the initiator module 100 may retain a portion of an initiation device to the mounting portion 104 proximate to an external surface of the initiator module 100. In some embodiments, the mounting portion 104 of the initiator module 100 may provide a seat for an initiation device between elements of the mounting portion 104. For example, the mount 118 may include a rigid element 120 and a biasing element 122. The rigid element 120 may include one or more protrusions extending from the mounting portion 104 of the initiator module 100. The biasing element 122 may include one or more at least partially flexible protrusions extending from the mounting portion 104 of the initiator module 100. As discussed in further detail below, the biasing element 122 may be flexed or bent in a direction away from the rigid element 120 in order to fit a portion of an initiation device between the rigid element 120 and the biasing element 122, thereby, at least partially securing the initiation device to the mounting portion 104 of the initiator module 100.

The initiator module 100 may comprise any of a variety of materials such as, for example, polymers, metals, alloys, composites, and combinations thereof. For example, the housing 101 of the initiator module 100 may be formed from a polymer (e.g., a high-performance polymer, a thermoplastic, etc.). In some embodiments, the housing may comprise a composite polymer material including a metal (e.g., Poly(p-phenylene oxide) (PPO) including stainless steel fibers that may improve shielding from electromagnetic interference). By way of further example, components of the initiator module 100 such as the latch 108 and portions of the mount 118 (e.g., the biasing element 122) may be formed from a polymer such as, for example, a super tough nylon.

FIG. 2 is a partial cross-sectional view of the initiator module shown in FIG. 1. As shown in FIG. 2, the housing 101 of the initiator module 100 houses a portion of an initiation assembly which may include an electronics assembly 124 and a detonator device 132. The electronics assembly 124 may include a printed circuit board including associated electronic components to form a printed circuit assembly 126 and ribbon cables 128, 130 located at each end of the printed circuit assembly 126. The electronics assembly 124 may be configured to receive an electrical signal from the munitions control system 110 and to supply a signal to the detonator device 132 in order to initiate another portion of the initiation assembly such as, for example, an initiation device mounted to the mounting portion 104 of the initiator module 100 which is in communication with an external device 160 (FIG. 3) (e.g., an explosive device such as, for example, lethal explosive devices (e.g., a M18A1 Claymore) and non-lethal explosive devices (e.g., an M5 Modular Crowd Control Munitions (MCCM)). The electronics assembly 124 may receive a voltage from the munitions control system 110 in order to detonate the detonator device 132 (e.g., an exploding foil initiator (EFI), a low energy exploding foil initiator (LEEFI), blasting cap, exploding-bridgewire detonator (EBW), etc.). For example, the electronics assembly 124 may receive a voltage (e.g., a voltage between about 500 volts and about 1500 volts) sufficient to ignite the detonator device 132 (e.g., a LEEFI) from the munitions control system 110 and transmit the voltage to the detonator device 132 in order to ignite the detonator device 132.

In some embodiments, the electronics assembly 124 may be configured to receive a signal from the munitions control system 110 and to send a signal in response to the signal from the munitions control system 110 that communicates the status of the initiator module 100. For example, the munitions control system 110 may send a signal inquiring of the status of the initiator module 100, and the electronics assembly 124 may assess the status of the initiator module 100 and respond with a signal to the munitions control system 110 regarding whether select components of the initiator module 100 (e.g., the detonator device 132) are operating or ready to operate in a desired manner (e.g., the initiator module 100 is ready to detonate the detonator device 132).

Figure 7:
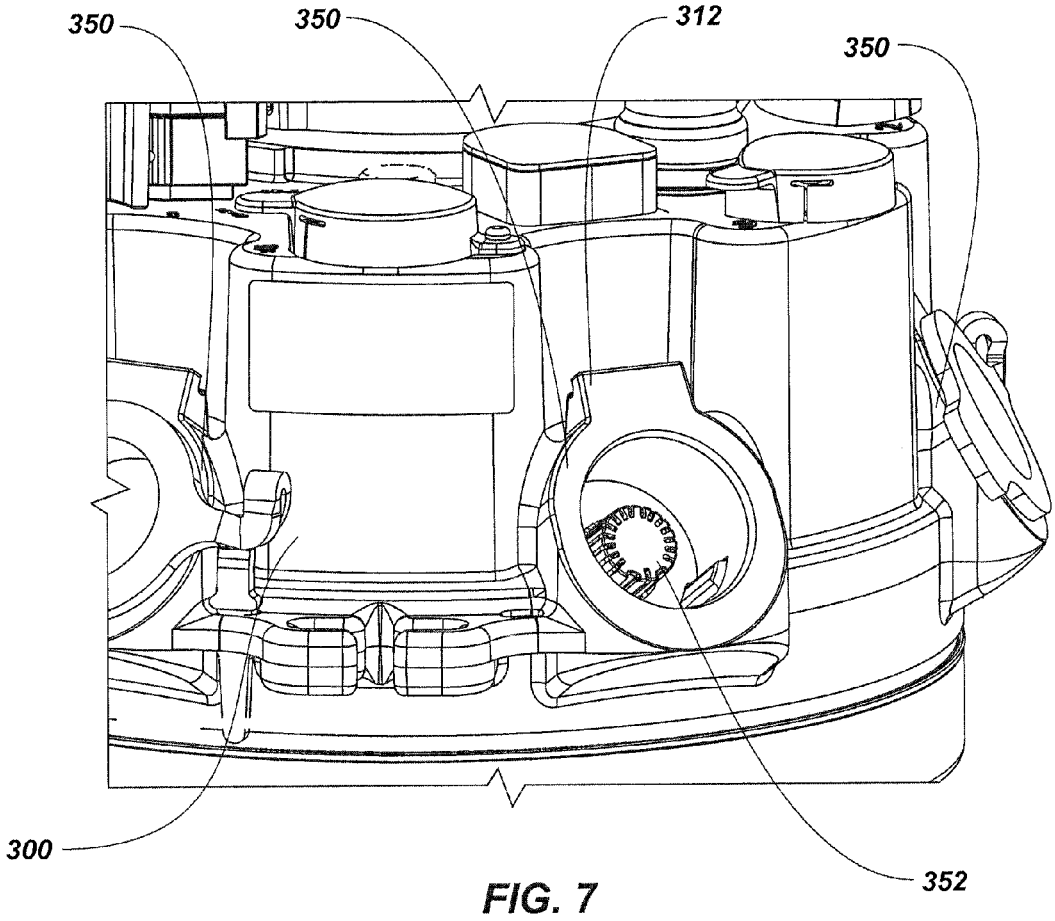
FIG. 7 is a perspective view of a portion of a munitions control system configured for receiving multiple initiator modules, like the initiator module of FIGS. 1 through 6.

The electronics assembly 124 may be selectively electrically connected to the munitions control system 110 through the connection portion 106 of the initiator module 100 (i.e., the electronics assembly 124 may be connected to the munitions control system 110 when the initiator module 100 is coupled to the munitions control system 110). For example, the first ribbon cable 128 may electrically couple the printed circuit assembly 126 to an electrical connector 134. The electrical connector 134 may be complementary to an electrical connector 152 of the munitions control system 110. For example, the electrical connector 134 may be complementary to an electrical connector 352 (e.g., a 15-pin connector, a 17-pin connector, etc.) of a munitions control system 300 as shown in FIG. 7.

Referring still to FIG. 2, the electronics assembly 124 may be electrically connected to the detonator device 132. For example, the second ribbon cable 130 may electrically couple the printed circuit assembly 126 to the detonator device 132.

Figure 3:
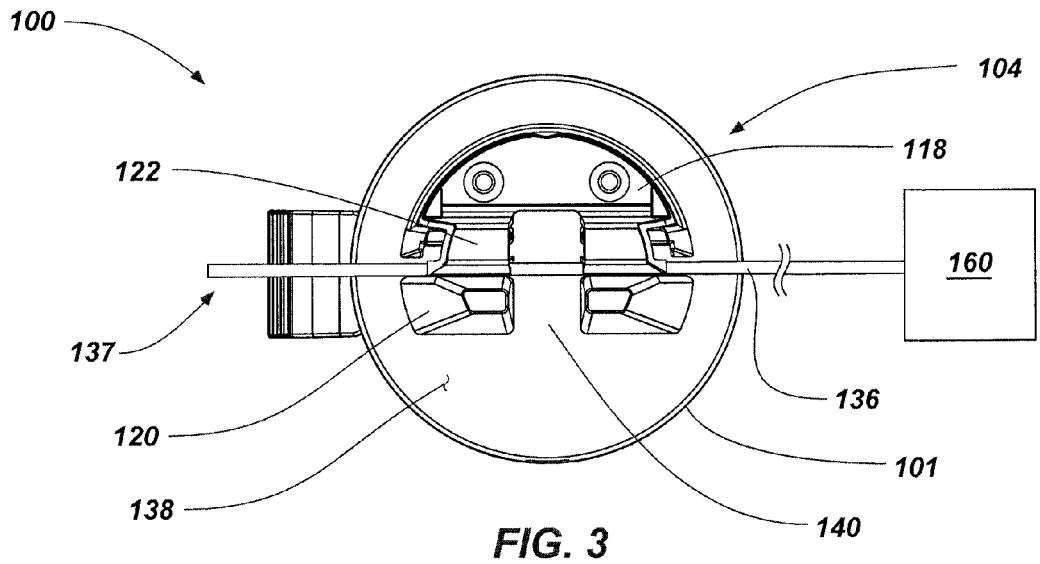
FIG. 3 is a top view of the initiator module shown in FIG. 1 with an initiation device coupled thereto.

FIG. 3 is a top view of the initiator module 100 with an initiation device coupled thereto. As shown in FIG. 3, the mount 118 may be formed on the mounting portion 104 of the initiator module 100 and may include an assembly for retaining a portion of an initiation device such as, for example, a shock tube 136. In some embodiments, the mount 118 may retain portions of a plurality of initiation devices (e.g., a plurality of shock tubes). A shock tube (also known as a signal transmission line) is a type of initiation device that transmits a detonation signal to a remotely located explosive using a pressure signal. A shock tube may be made of non-conductive materials, which are not generally susceptible to premature detonation caused by stray electro-magnetic radiation. The shock tube may include an explosive material within the shock tube and, when the shock tube is initiated, the explosive material combusts and propagates down the tube (e.g., at a rate of about 2000 meters per second (approximately 6560 feet per second)). A relatively small amount of explosive material may be used, such that the explosive effects are contained within the shock tube and the shock tube does not burst open as the ignited explosive propagates through the shock tube. When propagation of the ignited explosive material within the shock tube reaches a predetermined point (e.g., an external device) along the shock tube, the propagation of the ignited explosive material may be converted into useful work such as, for example, initiating a detonator (e.g., a blasting cap), igniting a gas generator, pushing a piston, etc.

As discussed above with reference to FIG. 1, the mount 118 may include a rigid element 120 and a biasing element 122. The rigid element 120 and the biasing element 122 may cooperatively at least partially secure the shock tube 136 to the mounting portion 104 of the initiator module 100. It is noted that while the embodiment of FIG. 3 illustrates the mounting portion 104 of the initiator module 100 receiving a portion of a shock tube 136, other initiation devices used to ignite an explosive material may also by retained by the mounting portion 104 (e.g., fuses, detonation cord, etc.).

Referring still to FIG. 3, the mount 118 may retain a portion of the shock tube 136 proximate to an external surface of the initiator module 100. For example, the mount 118 may retain the shock tube 136 proximate to an external surface 138 of a wall 140 of the initiator module 100 located at the mounting portion 106 of the initiator module 100. The shock tube 136 may be mounted to the initiator module 100 by the mount 118 such that a side or longitudinal portion (e.g., a portion of the cylindrical wall forming the shock tube 136) is mounted proximate to or in contact with the wall 140 of the initiator module 100. In some embodiments, an enclosed side portion of the shock tube 136 may be may be mounted to the mounting portion 104 of the initiator module 100. For example, the shock tube 136 may be substantially enclosed at one end of the shock tube 136 (i.e., an enclosed end 137) such that it is not required to be cut or opened to initiate the explosive material housed therein. The enclosed end 137 of the shock tube 136 may be mounted to the initiator module 100 for initiation while not exposing the internal components of the shock tube 136 (the explosive material disposed therein) to contaminants. In some embodiments, one or both of the initiator module 100 and the shock tube 136 may be substantially enclosed to at least partially prevent contamination or damage to internal components thereof. For example, as shown in FIG. 2, the detonator device 132 and electronics assembly 124 may be housed in a substantially enclosed chamber within the initiator module 100 without the need to expose the detonator device 132 and electronics assembly 124 to be in direct contact with the shock tube 136. In other words, the detonator device 132 and electronics assembly 124 may ignite the shock tube 136 from within the housing 101 of the initiator module 100 through the wall 140 of the initiator module 100 while the shock tube 136 is disposed on the exterior of the initiator module 100 (e.g., proximate to the external surface 138).

Figure 4:
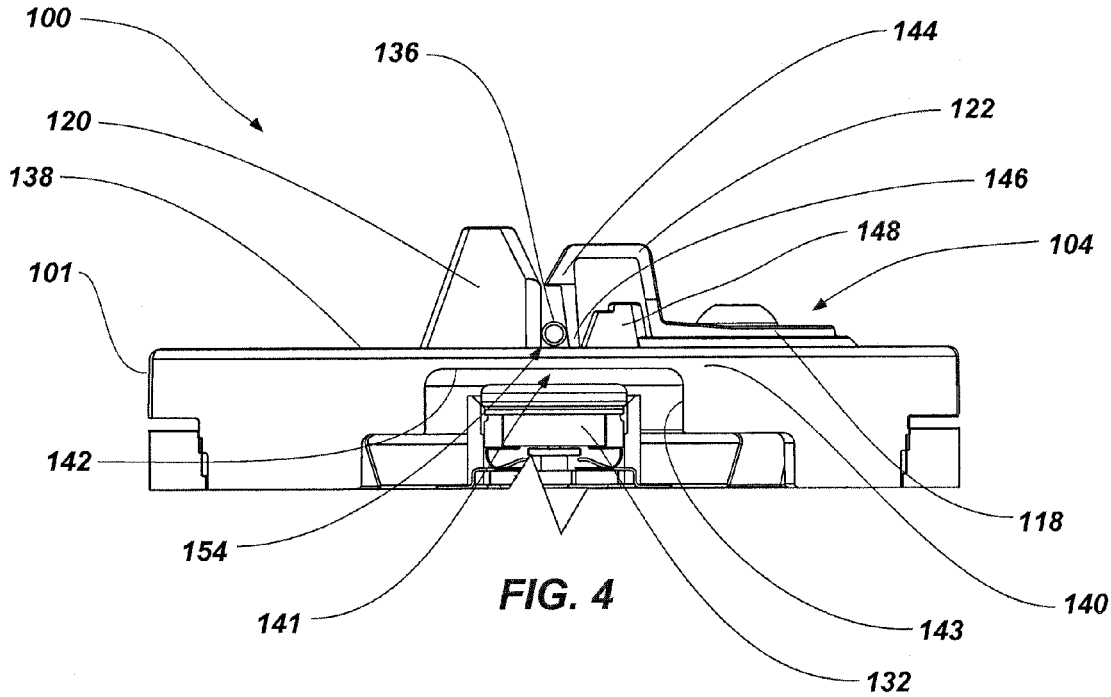
FIG. 4 is a partial, enlarged cross-sectional view of the initiator module shown in FIG. 3 having an initiation device coupled thereto.

FIG. 4 is a partial cross-sectional view of the initiator module shown in FIG. 3 having an initiation device coupled thereto. As shown in FIG. 4, the mount 118 may position the shock tube 136 at a location proximate to the detonator device 132 that is located within the housing 101 of the initiator module 100. For example, the detonator device 132 may be positioned within the initiator module 100 proximate to a side of the wall 140 (e.g., an internal surface 142) of the initiator module 100. The mount 118 may position a portion of the shock tube 136 on the opposing side of the wall 140 (i.e., the external surface 138) such that a portion of the shock tube 136 is located proximate to the detonator device 132. In some embodiments, the mount 118 may position a portion of the shock tube 136 on a side of the wall 140 proximate to the detonator device 132 located on an opposing side of the wall 140 such that the portion of the shock tube 136 is located within a blast radius of the detonator device 132. In other words, the portion of the shock tube 136 is positioned such that detonation of the detonator device 132 will ignite the shock tube 136. In some embodiments, the shock tube 136 may be mounted to the initiator module 100 by the mount 118 such that a longitudinal portion of the shock tube 136 is mounted proximate to a side of the wall 140 (e.g., the external surface 138 of the wall 140) of the initiator module 100 having the detonator device 132 disposed on an opposing side of the wall 140 (e.g., the internal surface 142 of the wall 140). In additional embodiments, the mount 118 may retain a portion of the shock tube 136 in contact with the wall 140 of the initiator module 100 (e.g., into contact with the external surface 138 of the wall 140).

The detonator device 132 may be positioned proximate to the internal surface 142 of the wall 140 of the initiator module 100 in order to deliver a shock wave through the initiator module 100 (e.g., through the wall 140) to the shock tube 136 mounted to the initiator module 100 at the mounting portion 104. For example, detonation of the detonator device 132 may deform or perforate a portion of the wall 140 of the initiator module 100. In some embodiments, the initiator module 100 may include a weakened portion 141 of the wall 140 having a thickness less than that of the remaining wall 140 (i.e., the thickness of the weakened portion 141 of the wall 140 is relatively less than a thickness of an adjacent portion of the wall 140). In such an embodiment, detonation of the detonator device 132 may deform or perforate (e.g., form a hole through) the weakened portion 141 of the wall 140 of the initiator module 100. In additional embodiments, the wall 140 of the initiator module 100 may include a recessed portion 143 that may at least partially house the detonator device 132 proximate to the mounting portion 104 of the initiator module 100. For example, the reduced thickness of the wall 140 at the weakened portion 141 may form the recessed portion 143 in the wall 140 and the detonator device 132 may be at least partially disposed in the recessed portion 143. The shock wave from detonation of the detonator device 132 may travel through the wall 140 to the shock tube 136 and ignite the shock tube 136. For example, the shock wave from detonation of the detonator device 132 may travel through a side portion or longitudinal portion of the shock tube 136 and ignite the explosive material contained within the shock tube 136. The propagation of the ignited explosive material within the shock tube 136 may travel longitudinally along the shock tube 136 to a predetermined point such as, for example, an external device 160 (e.g., a detonator of an explosive device such as, for example, a M18A1 Claymore, a MCCM, etc.).

As further shown in FIG. 4, the mount 118 may secure the shock tube 136 proximate to the initiator module 100. In some embodiments, the mount 118 may be of a design, structure and material sufficient to retain the shock tube 136 proximate to the initiator module 100 during the detonation of the detonator device 132. For example, the mount 118, including the rigid element 120 and the biasing element 122, may at least partially retain the shock tube 136 proximate to the initiator module 100 as forces resultant from the detonation of the detonator device 132 may act to force the shock tube 136 in an outward direction away from the initiator module 100.

In order to retain the shock tube 136, the biasing element 122 may be flexed or bent in a direction away from the rigid element 120 to fit the shock tube 136 between the rigid element 120 and the biasing element 122, thereby, at least partially securing the shock tube 136 to the mounting portion 104 of the initiator module 100. For example, an upper portion 144 of the biasing element 122 may retain the shock tube 136 in a channel 154 formed between the rigid element 120 and the biasing element 122. It is noted that the terms "upper" and "lower" discussed herein with reference to the mount 118 describe upper and lower portions of the mount 118 as it is oriented in FIG. 4. In some embodiments, the upper portion 144 of the biasing element 122 may be spaced from the rigid element 120 a distance less than the diameter of the shock tube 136. In such an embodiment, the upper portion 144 of the biasing element 122, in a relaxed state, may secure the shock tube 136 in the channel 154 formed between the rigid element 120 and the biasing element 122. The shock tube 136 may be inserted into the mount 118 to extend partially through the channel 154 formed between the rigid element 120 and the biasing element 122 by flexing the upper portion 144 of the biasing element 122 away from the rigid element 120. In some embodiments, the biasing element 122 may include a lower portion 146 that may act to force the shock tube 136 toward the wall 140 of the initiator module 100. For example, the lower portion 146 of the biasing element 122 may force the shock tube 136 into contact with the wall 140 at location proximate to the detonator device 132 located on an opposing side of the wall 140. In some embodiments, the mount 118 may include a backstop 148 that may restrict lateral movement of the lower portion 146 of the biasing element 122 and may facilitate positioning of a portion of the shock tube 136 proximate to the detonator device 132 located within the initiator module 100.

Figure 5:
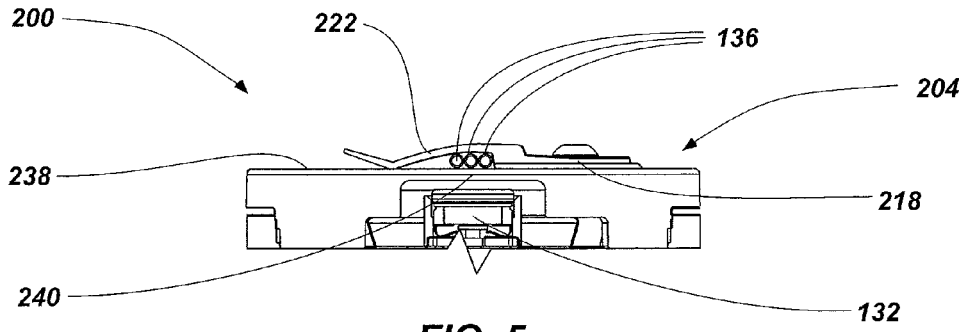
FIG. 5 is a side view of a portion of an embodiment of an initiator module of the present invention with an initiation device coupled thereto.

FIG. 5 is a side view of a portion of an embodiment of an initiator module 200 of the present invention with an initiation device coupled to the initiator module. The initiator module 200 may be substantially similar to the initiator module 100 shown and described with reference to FIGS. 1 through 4, but having a differently configured mounting portion 204 as depicted in FIG. 5. The initiator module 200 may include a mount 218 located on the mounting portion 204 thereof that positions the shock tube 136 (or as shown in FIG. 5, a plurality of shock tubes 136) at a location proximate to the detonator device 132 which is located within the initiator module 200. The mount 218 may include a biasing element 222 that may extend, in a lateral direction, across a portion of the mounting portion 204 of the initiator module 200. The biasing element 222 may be flexed or bent in a direction away from the initiator module 200 in order to fit the shock tube 136 or tubes between an external surface 238 of a wall 240 of the initiator module 200 and the biasing element 222. The biasing element 222 may at least partially secure the shock tube 136 to the mounting portion 204 of the initiator module 200. For example, the biasing element 222 may act to force the shock tube 136 toward the wall 240 of the initiator module 200 proximate to the detonator device 132 located on an opposing side of the wall 240.

Figure 6:
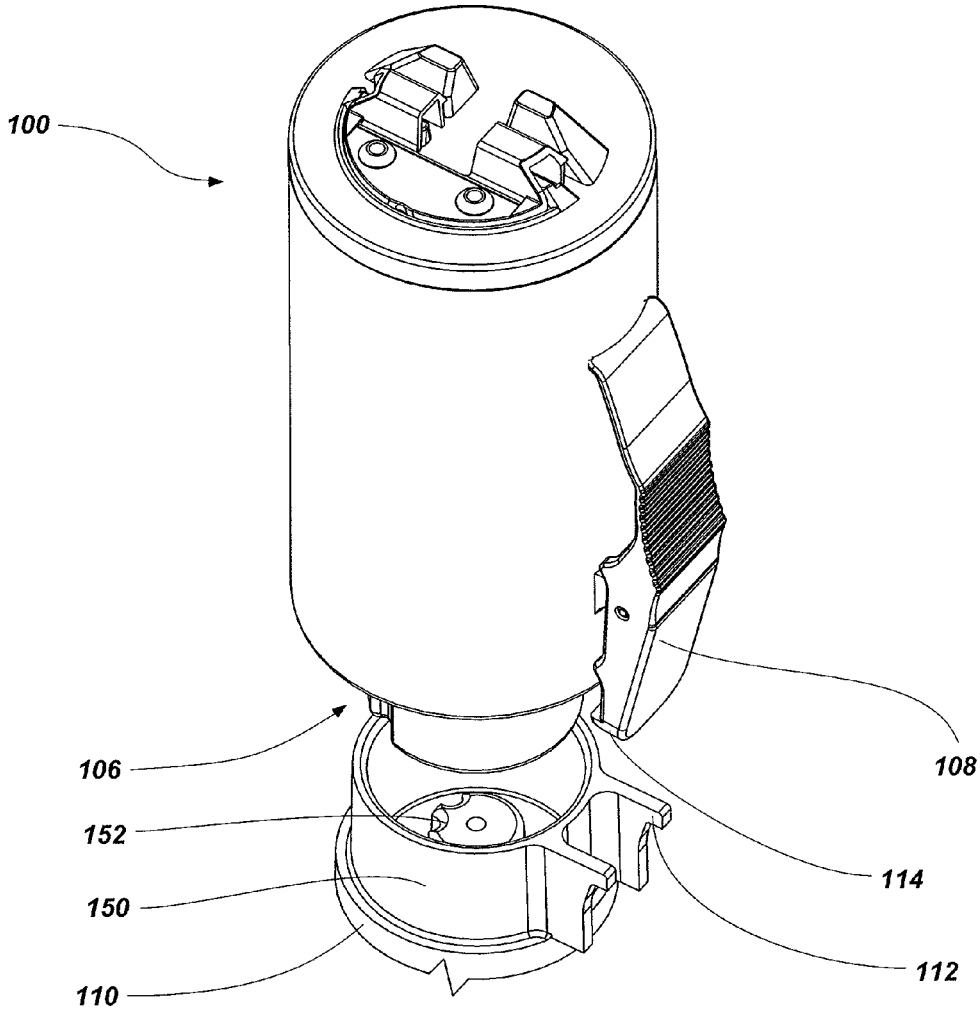
FIG. 6 is a side view of an embodiment of an initiator module of the present invention and a portion of a munitions control system.

FIG. 6 is side view of an embodiment of an initiator module of the present invention and a portion of a munitions control system 110. As shown in FIG. 6, the connection portion 106 of the initiator module 100 may be received in a complementary socket 150 of the munitions control system 110. For example, the connection portion 106 of the initiator module 100 may be received in the complementary socket 150 of the munitions control system 110 to connect the electrical connector 134 (FIG. 2) of the initiator module 100 to a complementary electrical connector 152 of the munitions control system 110. As discussed above, when the connection portion 106 of the initiator module 100 is received in the complementary socket 150 of the munitions control system 110, the latching portion 114 of the latch 108 may engage under a bias with the complementary latching portion 112 of the socket 150 of the munitions control system 110 to prevent unwanted uncoupling of the initiator module 100 from the munitions control system 110.

FIG. 7 is perspective view of a portion of a munitions control system configured for receiving multiple initiator modules, for example, the initiator module of FIGS. 1 through 6. As shown in FIG. 7, the munitions control system may include a munitions control system 300 (e.g., a Spider munitions control system) operably coupled with a plurality of sockets 350. Each socket 350 may include a latching portion 312 for engaging an initiator module (e.g., the initiator modules 100, 200 shown and described with reference to FIGS. 1 through 6). Each socket 350 may also include an electrical connector 352 that is complementary to the electrical connector 134 (FIG. 2) of the initiator modules (e.g., the initiator modules 100, 200 (FIGS. 1 through 6)).

Referring back to FIG. 2, in operation, the connection portion 106 of the initiator module 100 may be received in the complementary socket 150 of the munitions control system 110 to connect the electrical connector 134 of the initiator module 100 to the electrical connector 152 of the munitions control system 110. The latching portion 114 of the latch 108 of the initiator module 100 may engage with the complementary latching portion 112 of the complementary socket 150 of the munitions control system 110 to secure the initiator module 100 to the munitions control system 110.

The electronics assembly 124 of the initiator module 100 may receive an electrical signal (e.g., a voltage less than the voltage required to detonate the detonator device 132 such as, for example, 12 volts) from the munitions control system 110 transmitted through the electrical connectors 134, 152 to provide a power source for the initiator module 100. The electrical connector 134 of the initiator module 100 may send a signal transmitted to the munitions control system 110, again through the electrical connectors 134, 152 regarding the status of the initiator module 100 (e.g., a signal indicating that the initiator module 100 is in a ready condition to detonate the detonator device 132 disposed therein). The electronics assembly 124 of the initiator module 100 may then receive a relatively larger voltage transmitted from the munitions control system 110 (e.g., about 1200 volts) in order to detonate the detonator device 132 (e.g., a LEEFI).

Referring now to FIG. 4, detonation of the detonator device 132 delivers a shock wave through the initiator module 100 (e.g., through the wall 140) to the initiation device (e.g., the shock tube 136) mounted thereto. For example, detonation of the detonator device 132 may deform or perforate a portion of the wall 140 (e.g., the weakened portion 141 designed to have a thickness less than that of the remaining wall 140) of the initiator module 100. The shock wave from detonation of the detonator device 132 may travel through the wall 140 to the shock tube 136 and ignite a portion of the shock tube 136. For example, the shock wave from detonation of the detonator device 132 may travel through (e.g., deform or perforate) a side portion of the shock tube 136 and ignite the explosive material contained within the shock tube 136. The propagation of the ignited explosive material within the shock tube 136 may travel along the shock tube 136 to the external device 160 (FIG. 3).

The initiator module 100 may be configured to promote a relatively small shock magnitude during detonation of the detonator device (e.g., the LEEFI). For example, the initiator module 100 may be configured to promote a shock magnitude (i.e., g-force) less than 2000 g.

Once the detonator device 132 has been detonated by the electronics assembly 124, the electronics assembly 124 may act to terminate the supply electrical power to the initiator module 100. For example, the electronics assembly 124 may send a signal to the munitions control system 110 indicating that the detonator device 132 has fired in order to cease electrical power from being supplied to the initiator module 100 from the munitions control system 110. The deformation or perforation of the weakened portion 141 of the wall 140 may provide a visual indicator that the initiator module 100 has been detonated. For example, a deformed or perforated external surface 138 of the wall 140 of the initiator module 100 (e.g., a bulge or a hole formed therein) may indicate to a user that the detonator device 132 of the initiator module 100 has been detonated.

In view of the above, embodiments of the present invention may be particularly useful in providing an initiation module for a munitions control system that enables detonation of a device external to the munitions control system. The initiation module provides initiation of external devices while providing an electronic assembly that is compatible with features of a munitions control system such as ESAD features, portability features, etc. The initiation module further provides initiation of external devices using a remotely controlled munitions control system (i.e., the initiator module may be operated by remote control rather than manual control). The external mounting of initiation devices such as shock tubes to the initiator module enables the initiator module and the shock tube to be substantially enclosed and at least partially prevents contamination or damage to internal components thereof. The mounting portion may remove the need for having to cut or otherwise provide an open end of a shock tube in order to detonate the shock tube. As such, deployed shock tubes (including any shock tube terminations (e.g., seal caps, primers, M81s, etc.)) that are not used (i.e., detonated) may be repackaged and reused at a later time. The mounting portion also may provide a seat for a wide range of shock tube sizes and configurations which positions the enclosed shock tube at an external surface of the initiator module proximate to a detonation device. Such a configuration may reduce environmental and physical connection issues exhibited by initiation devices that require the shock tube to be installed within the initiation device. Furthermore, the configuration of the mounting portion of the initiator module may remove the need for an internal detonation device disposed within the shock tube in order to detonate the shock tube. The mounting portion may also provide a visual indicator (e.g., a perforated or deformed mounting portion) that the initiator module has been detonated.

The ability of the initiator module to implement initiation devices such as shock tubes and detonator devices such as LEEFIs enables the initiator module and munitions control system to be less susceptible to electrical conditions (e.g., electromagnetic interference (EMI), electrostatic discharge (ESD), radio interference, etc.) as compared to other initiation devices. The initiator module may further provide a relatively small shock magnitude during detonation of the detonator devices such as the LEEFI which may be desirable when the initiator module is utilized in a munitions control system such as the Spider that includes a disturbance sensor therein (e.g., a disturbance sensor to detect external tampering with the system), which may otherwise be inadvertently activated by the initiation of a detonator.

While the initiator modules and munitions control systems have been described herein with general reference to military applications, it is noted that initiator modules and munitions control systems may be utilized in other applications such as, for example, mining and drilling operations and demolition.

While the present invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, legal equivalents, and alternatives falling within the scope of the invention as defined by the following appended claims.

What is claimed is:

1. An initiator module for a munitions control system, comprising:

a housing comprising:

a mounting portion for receiving a longitudinal portion of an initiation device, the mounting portion formed on an external surface of an external wall of the housing; and a connection portion configured to connect the initiator module with the munitions control system;

a detonator device disposed within the housing of the initiator module at a location proximate to an internal surface of the external wall of the housing opposing the external surface of the external wall and the mounting portion, wherein the mounting portion is configured to position the longitudinal portion of the initiation device to extend along the external surface of the external wall of the housing proximate to the detonator device positioned on the opposing internal surface of the external wall of the housing; and an electronics assembly electrically coupled to the detonator device and configured to electronically couple with the munitions control system through the connection portion and to transmit a signal from a munitions control system through the connection portion to the detonator device.

2. The initiator module of claim 1, wherein the mounting portion is configured to receive an initiation device comprising a shock tube.

3. The initiator module of claim 1, wherein the connection portion comprises an electrical connection and a latch, wherein the electrical connection is configured to be cooperatively received in a socket of a munitions control system and wherein the latch is configured to selectively secure the initiator module to a munitions control system.

4. An initiator module for a munitions control system, comprising:

a housing comprising:

a mounting portion for receiving a longitudinal portion of an initiation device; and a connection portion configured to connect the initiator module with the munitions control system;

a detonator device disposed within the housing of the initiator module at a location proximate to the mounting portion, wherein the detonator device comprises an exploding foil initiator; and an electronics assembly electrically coupled to the detonator device and configured to electronically couple with the munitions control system through the connection portion and to transmit a signal from a munitions control system through the connection portion to the detonator device.

5. The initiator module of claim 4, wherein the electronics assembly is configured to deliver a signal from a munitions control system comprising between 500 and 1500 volts to the exploding foil initiator in order to detonate the exploding foil initiator.

6. An initiator module for a munitions control system, comprising:

a housing comprising:

a mounting portion for receiving a longitudinal portion of an initiation device; and a connection portion configured to connect the initiator module with the munitions control system;

a detonator device disposed within the housing of the initiator module at a location proximate to the mounting portion; and an electronics assembly electrically coupled to the detonator device and configured to electronically couple with the munitions control system through the connection portion and to transmit a signal from a munitions control system through the connection portion to the detonator device, wherein the mounting portion comprises a rigid element and a biasing element protruding from the mounting portion of the initiator module and wherein a longitudinal portion of a shock tube is received and retained between the rigid element and the biasing element of the mounting portion.

7. An initiator module for a munitions control system, comprising:

a housing comprising:

a mounting portion for receiving a longitudinal portion of an initiation device; and a connection portion configured to connect the initiator module with the munitions control system;

a detonator device disposed within the housing of the initiator module at a location proximate to the mounting portion; and an electronics assembly electrically coupled to the detonator device and configured to electronically couple with the munitions control system through the connection portion and to transmit a signal from a munitions control system through the connection portion to the detonator device, wherein the mounting portion comprises a biasing element configured to secure an initiation device comprising a longitudinal portion of a shock tube to a first side of a wall of the initiator module and wherein the detonator device is disposed within the initiator module proximate to a second, opposing side of the wall of the initiator module.

8. The initiator module of claim 7, wherein the wall of the initiator module comprises a portion having a thickness less than a thickness of an adjacent portion of the wall.

9. The initiator module of claim 8, wherein the wall of the initiator module comprises a recessed portion having the lesser thickness and wherein at least a portion of the detonator device is disposed in the recessed portion of the wall.

10. A munitions system, comprising:

a munitions control system having at least one socket formed therein; and at least one initiator module as recited in claim 1 received in the at least one socket of the munitions control system.

11. The munitions system of claim 10, wherein the detonator device of the at least one initiator module comprises an exploding foil initiator and wherein the exploding foil initiator comprises a low energy exploding foil initiator requiring less than 1500 volts to initiate.

12. The munitions system of claim 11, wherein the electronics assembly is configured to deliver a signal comprising between 500 and 1500 volts generated by the munitions control system to the low energy exploding foil initiator in order to initiate the exploding foil initiator.

13. The munitions system of claim 10, wherein the mounting portion further comprises a rigid element and wherein the longitudinal portion of a shock tube is received and retained in a seat formed between the rigid element and a biasing element of the mount.

14. The munitions system of claim 13, wherein the seat retains the longitudinal portion of the shock tube in contact with the external surface of the external wall of the housing of the initiator module.

15. The munitions system of claim 10, wherein an electrical connector of the initiator module comprises a pin connector that nondestructively attaches and detaches from a complementary electrical connector of the at least one socket of the munitions control system.

16. The munitions system of claim 15, wherein the at least one initiator module further comprises a latch coupled thereto, the latch having a biased latching portion complementary to a latching portion of the at least one socket of the munitions control system, wherein engagement of the latching portion of the initiator module and the latching portion of the munitions control system secures the at least one initiator module to the at least one socket of the munitions control system.

17. A method of igniting an explosive device, the method comprising:

coupling a shock tube to an explosive device;

connecting the initiator module as recited in claim 1 to a munitions control system;

mounting a longitudinal portion of the shock tube to the mounting portion of the initiator module; and igniting the shock tube with the detonator device with a signal generated by the munitions control system.

18. The method of claim 17, wherein igniting the shock tube further comprises deforming or perforating the external wall of the initiator module with a shock wave generated by the detonator device.

19. The method of claim 17, wherein mounting a longitudinal portion of the shock tube comprises disposing the longitudinal portion of the shock tube between a rigid element and a biasing element of the mount to retain the longitudinal portion of the shock tube in the mounting portion.

20. The method of claim 17, wherein igniting the shock tube with an initiation device disposed within the initiator module comprises:

directing a voltage greater than 500 volts from the munitions control system to the initiator module to detonate the detonator device comprising a low energy exploding foil initiator; and sending a signal from the initiator module to the munitions control system after detonation of the low energy exploding foil initiator.

* * * * *

UNITED STATES PATENT AND TRADEMARK OFFICE

CERTIFICATE OF CORRECTION

PATENT NO. : 8,408,132 B2
APPLICATION NO. : 12/723446
DATED : April 2, 2013
INVENTOR(S) : James D. Lucas, Denny L. Kurschner and Thomas E. MacPherson It is certified that error appears in the above-identified patent and that said Letters Patent is hereby corrected as shown below:

On the title page:

In ITEM (56) References Cited:

OTHER PUBLICATIONS

Page 1, 2nd column, 1st line of the 1st entry (line 23), change "Spyder," to --Spider,--

In the specification:

| | | |
|---|---|---|
| COLUMN 7, | LINE 24, | change "may be may be mounted" to --may be mounted-- |
| COLUMN 9, | LINE 65, | change "FIG. **7** is perspective" to --FIG. **7** is a perspective-- |

Signed and Sealed this
Twenty-first Day of October, 2014

Michelle K. Lee

Michelle K. Lee
*Deputy Director of the United States Patent and Trademark Office*